US010289038B2

(12) United States Patent
Murasaki

(10) Patent No.: US 10,289,038 B2
(45) Date of Patent: May 14, 2019

(54) FIXING DEVICE HAVING A SEPARATING MEMBER THAT SEPARATES A RECORDING MATERIAL FROM A CYLINDRICAL FILM

(71) Applicant: CANON KABUSHIKI KAISHA, Tokyo (JP)

(72) Inventor: Satoshi Murasaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/954,716

(22) Filed: Apr. 17, 2018

(65) Prior Publication Data

US 2018/0307165 A1 Oct. 25, 2018

(30) Foreign Application Priority Data

Apr. 21, 2017 (JP) ..... 2017-084417

(51) Int. Cl.
*G03G 15/20* (2006.01)

(52) U.S. Cl.
CPC ..... *G03G 15/2028* (2013.01); *G03G 15/206* (2013.01)

(58) Field of Classification Search
CPC ..... G03G 15/2028; G03G 15/206; G03G 15/2064; G03G 15/2032
See application file for complete search history.

(56) References Cited

U.S. PATENT DOCUMENTS

| | | | | |
|---|---|---|---|---|
| 5,517,292 | A * | 5/1996 | Yajima | G03G 15/2028 271/900 |
| 9,008,558 | B2 | 4/2015 | Saito et al. | |
| 2011/0236069 | A1* | 9/2011 | Arikawa | G03G 15/2028 399/122 |
| 2013/0189005 | A1* | 7/2013 | Saito | G03G 15/2028 399/323 |
| 2017/0205738 | A1* | 7/2017 | Hidaka | G03G 15/2028 |
| 2017/0277086 | A1* | 9/2017 | Hayase | G03G 15/2028 |

FOREIGN PATENT DOCUMENTS

| | | | |
|---|---|---|---|
| JP | 2006153948 | A | 6/2006 |
| JP | 2011180202 | A | 9/2011 |
| JP | 2013148730 | A | 8/2013 |
| JP | 2014228584 | A | 12/2014 |

* cited by examiner

*Primary Examiner* — Sophia S Chen
(74) *Attorney, Agent, or Firm* — Venable LLP

(57) ABSTRACT

A fixing device includes a cylindrical film, a nip forming member, a preventing member provided in a position opposing an end portion of the film with respect to a generatrix direction of the film and configured to prevent movement of the film in the generatrix direction, a frame, and a separating member configured to separate, from the film, a recording material discharged from the nip. The separating member is rotatable relative to the preventing member at a first portion thereof, and is slidable relative to the frame at a second portion thereof, the second portion being more remote from a surface of the film than the first portion, and a sliding direction of the separating member crossing a plane of the nip. The fixing device fixes, at the nip, a toner image on the recording material while nipping and feeding the recording material on which the toner image is formed.

12 Claims, 13 Drawing Sheets

(a)

(b)

FIXING DEVICE HAVING A SEPARATING MEMBER THAT SEPARATES A RECORDING MATERIAL FROM A CYLINDRICAL FILM

This application claims the benefit of Japanese Patent Application No. 2017-084417, filed on Apr. 21, 2017, which is hereby incorporated by reference herein in its entirety.

FIELD OF THE INVENTION AND RELATED ART

The present invention relates to a fixing device mountable to an image forming apparatus, such as an electrophotographic copying machine or an electrophotographic printer.

As the fixing device method in the copying machine or printer of an electrophotographic type, a fixing device of a film heating type has been known. The fixing device of this type includes a plate like heater, a flexible cylindrical film sliding on the heater, and a pressing roller for forming a nip in cooperation with the heater while sandwiching the film between itself and the heater. A recording material, on which an unfixed toner image is formed, is heated while being nipped and fed through the nip, whereby the toner image is fixed on the recording material.

In the fixing device of the film fixing type, with respect to a longitudinal direction perpendicular to a recording material feeding direction, outside end portions of the film, preventing members for preventing movement of the film in the longitudinal direction are provided. The preventing members are urged by pressing (urging) springs in a direction perpendicular to a generatrix direction of the film, whereby the film is pressed against the pressing roller by the heater.

Further, there is also a fixing device of a film fixing type in which, on a side downstream of the nip with respect to the recording material feeding direction, a separating member for separating a leading end of the recording material from an outer peripheral surface of the film is provided at a predetermined distance from the outer peripheral surface of the film.

Japanese Laid Open Patent Application No. 2006 153948 discloses a fixing device in which a preventing member is provided with a separating member in order to accurately hold a leading end position of the separating member on an upstream side of the recording material feeding direction in a state in which the separating member approaches a recording material separating portion of the film to the extent possible.

In the fixing device described above, even when a nip width changes with respect to the recording material feeding direction, it is required to compatibly realize a separating performance for separating the recording material from the outer peripheral surface of the film, and a stable recording material feeding performance after separation by using the separating member.

SUMMARY OF THE INVENTION

A principal object of the present invention is to provide a fixing device capable of compatibly realizing a recording material separating performance and a recording material feeding performance after separation by using a separating member even when a nip width changes.

In one aspect, the present inventions provides a fixing device comprising a cylindrical film, a nip forming member configured to form a nip between itself and the film in contact with an outer surface of the film, a preventing member provided in a position opposing an end portion of the film with respect to a generatrix direction of the film and configured to prevent movement of the film in the generatrix direction, a frame, and a separating member configured to separate, from the film, a recording material discharged from the nip, the separating member being rotatable relative to the preventing member at a first portion thereof, and being slidable relative to the frame at a second portion thereof, the second portion of the separating member being in a position that is more remote from a surface of the film than the first portion, and a sliding direction of the separating member crossing a plane of the nip, wherein the fixing device fixes, at the nip, a toner image on the recording material while nipping and feeding the recording material on which the toner image is formed.

Further features of the present invention will become apparent from the following description of exemplary embodiments with reference to the attached drawings.

Figure 7:
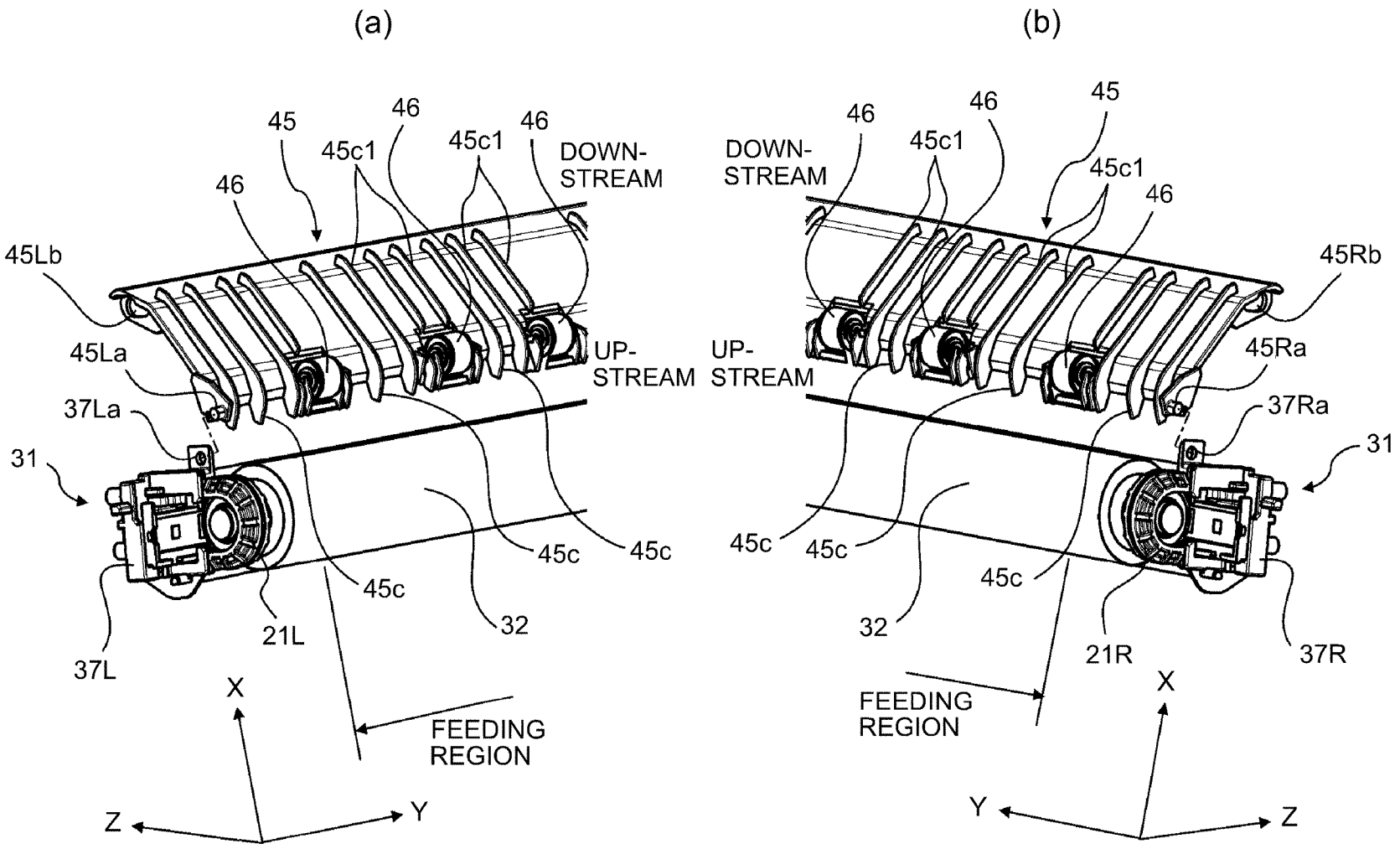

Parts (a) and (b) of FIG. 7 are perspective views of the film and a separating member as seen from a left side and a right side, respectively, with respect to a longitudinal direction perpendicular to the recording material feeding direction.

Figure 8:
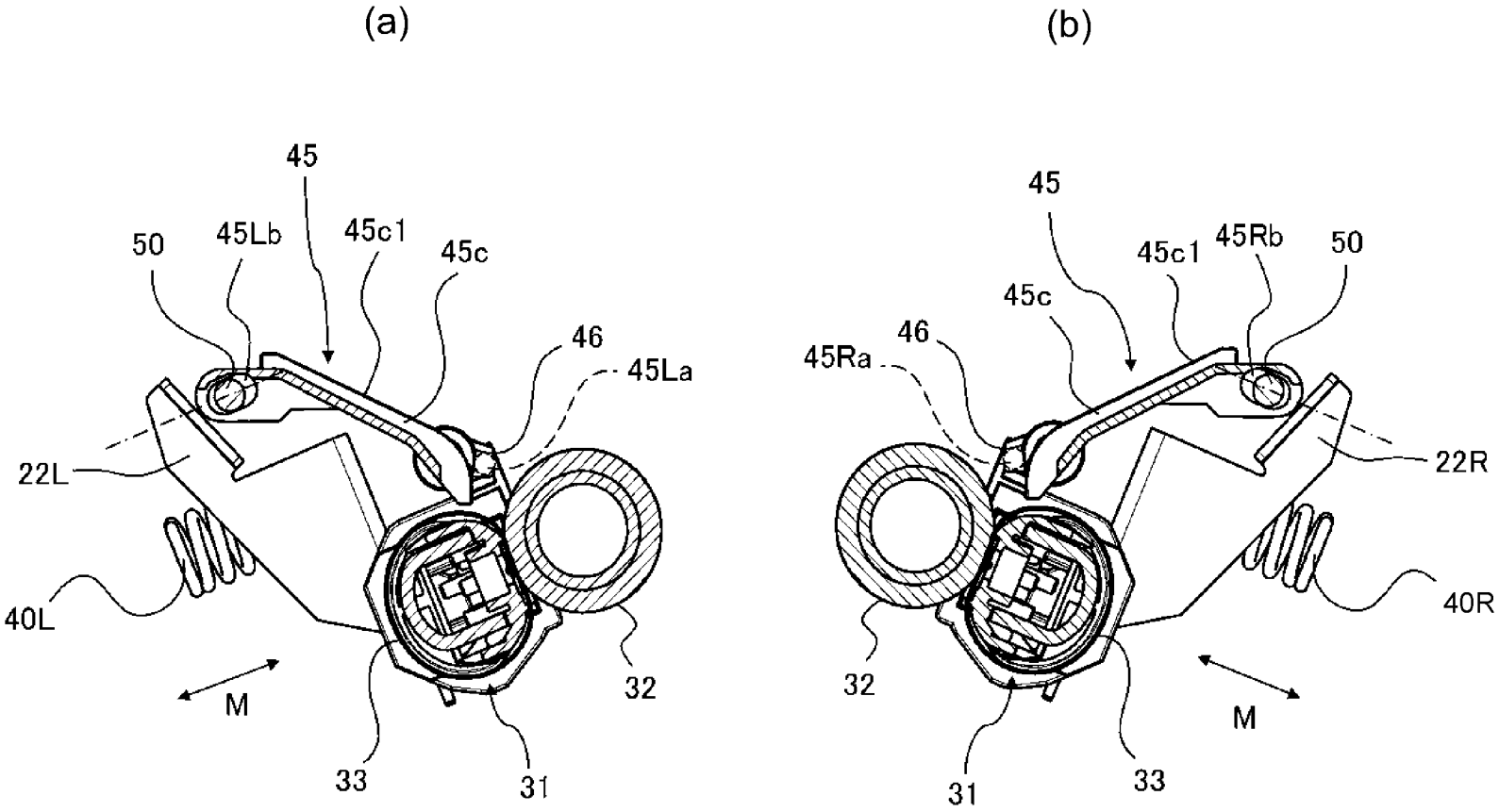

Parts (a) and (b) of FIG. 8 are sectional views of the separating member, the film, and the pressing roller as seen from the left side and the right side, respectively, with respect to the longitudinal direction perpendicular to the recording material feeding direction.

Figure 9:
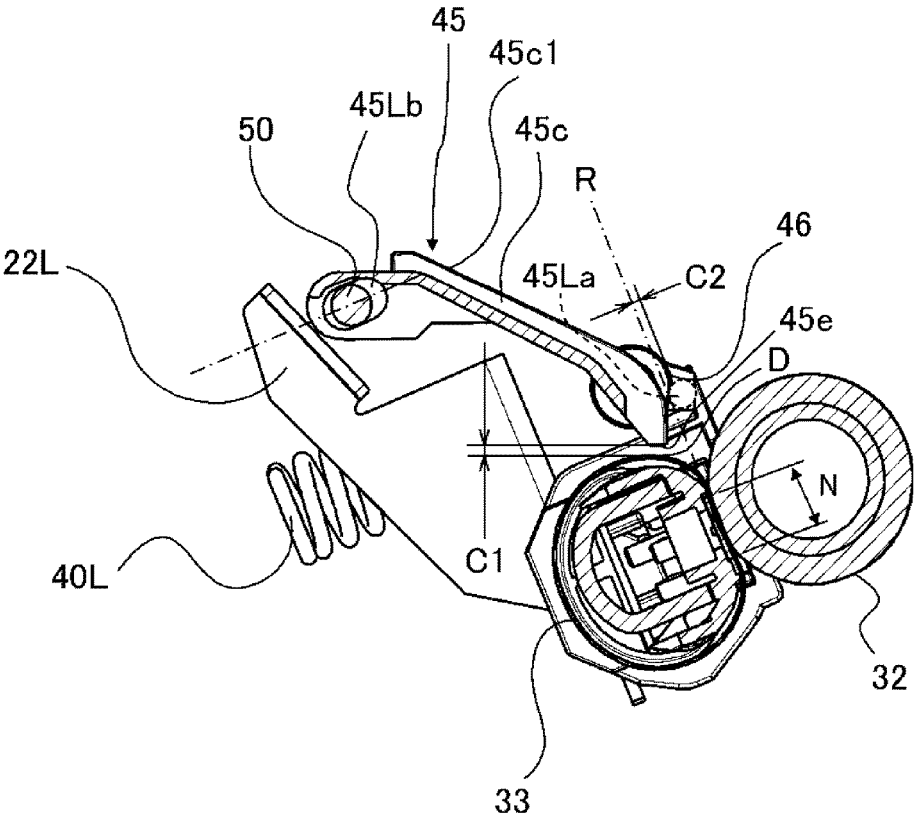

FIG. 9 is a sectional view of the separating member and the film as seen from the left side with respect to the longitudinal direction perpendicular to the recording material feeding direction in the case in which a nip width is not changed.

Figure 10:
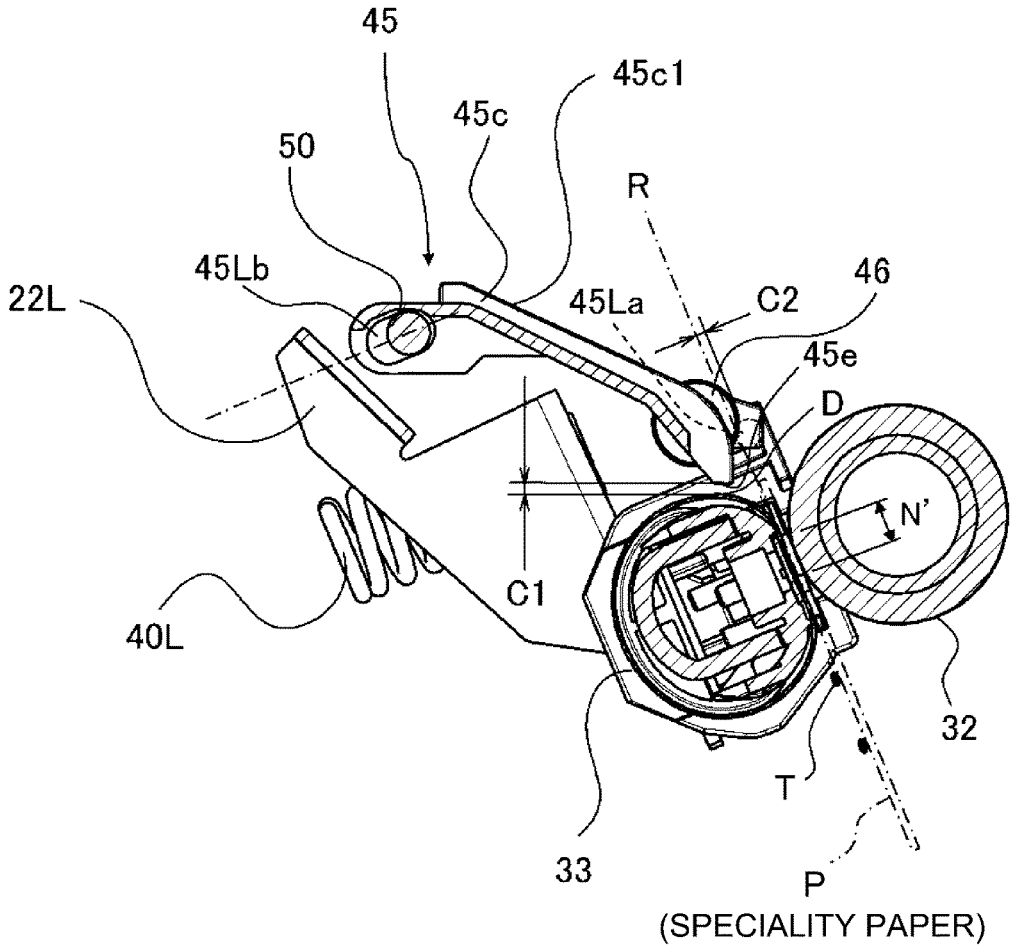

FIG. 10 is a sectional view of the separating member and the film as seen from the left side with respect to the longitudinal direction perpendicular to the recording material feeding direction in the case in which the nip width is changed.

Figure 11:
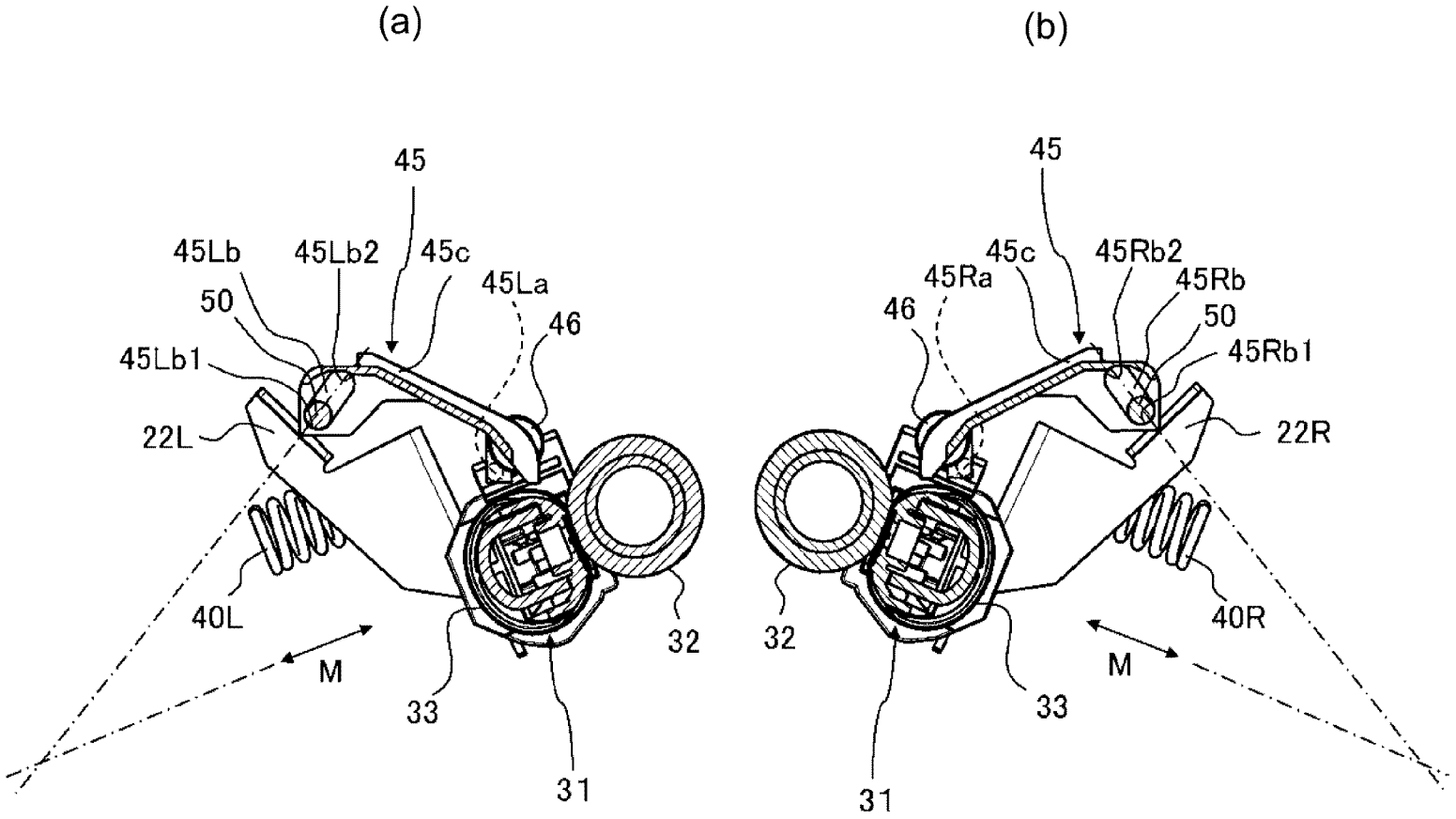

Parts (a) and (b) of FIG. 11 are sectional views of a separating member, a film, and a pressing roller of a fixing device according to Embodiment 2, as seen from a left side and a right side, respectively, with respect to a longitudinal direction perpendicular to a recording material feeding direction.

Figure 12:
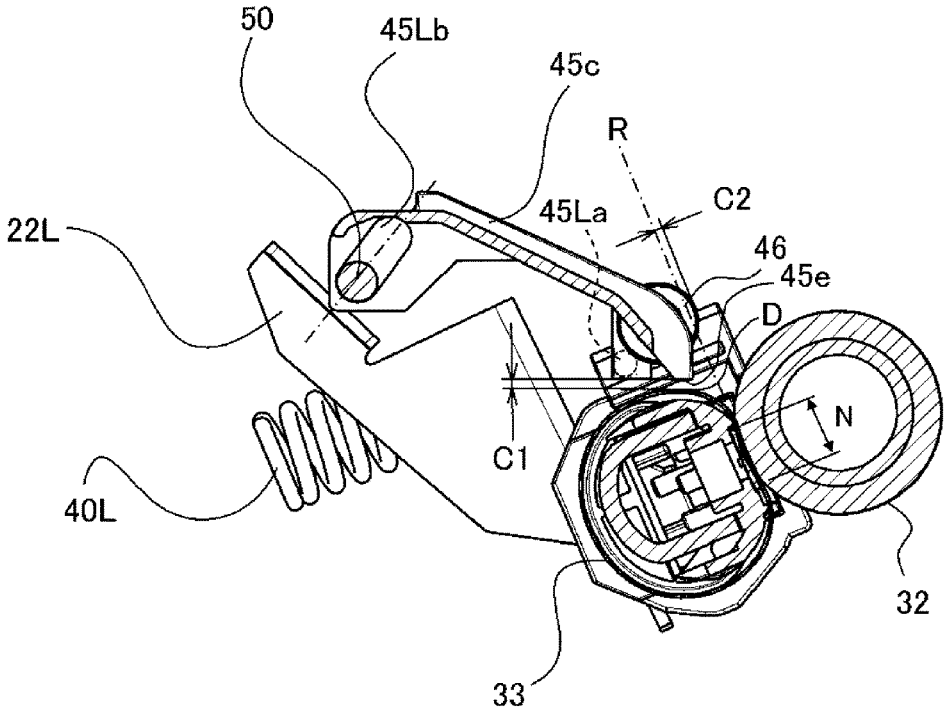

FIG. 12 is a sectional view of the separating member and the film as seen from the left side with respect to the longitudinal direction perpendicular to the recording material feeding direction in the case in which a nip width is not changed.

Figure 13:
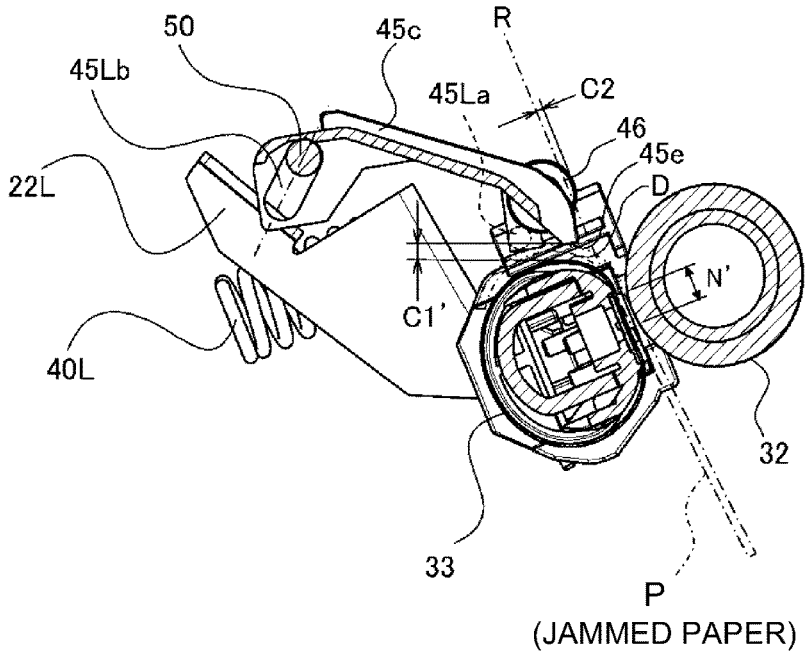

FIG. 13 is a sectional view of a separating member and the film as seen from the left side with respect to the longitudinal direction perpendicular to the recording material feeding direction in the case in which the nip width is changed.

Figure 14:
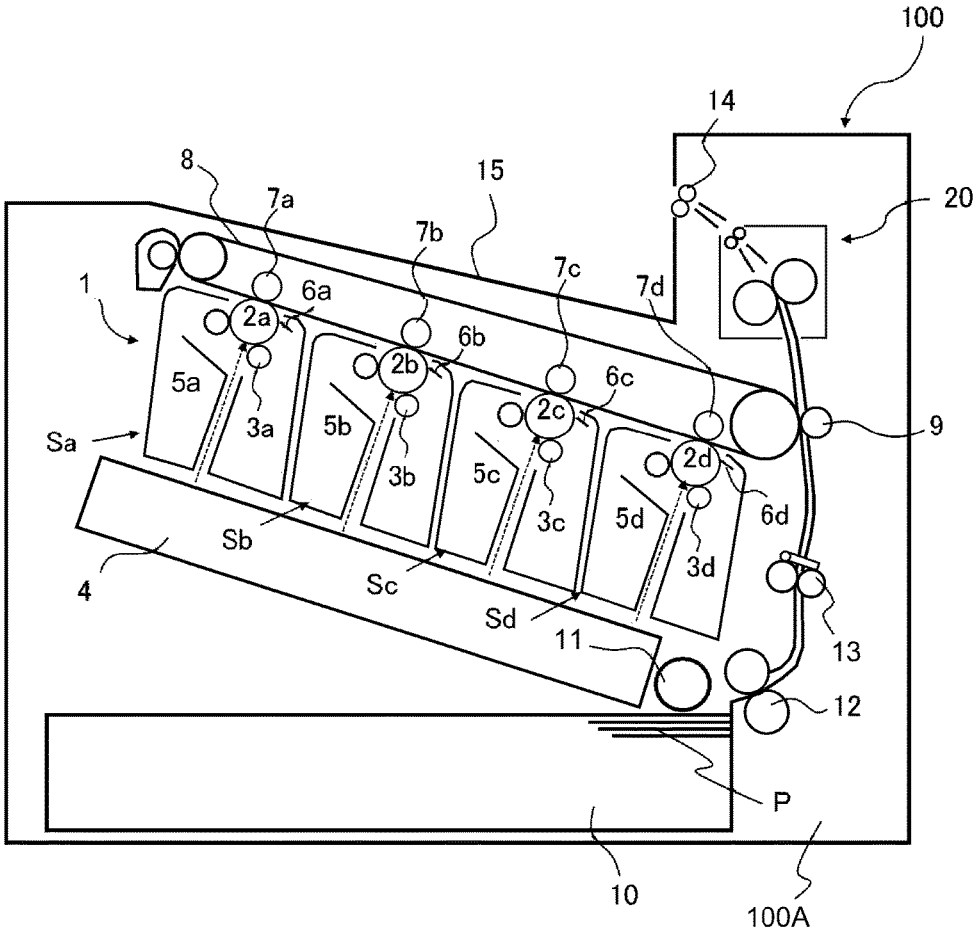

FIG. 14 is a sectional view showing a schematic structure of an image forming apparatus.

DESCRIPTION OF EMBODIMENTS

Embodiments of the present invention will be described with reference to the drawings. Although these embodiments are preferred embodiments of the present invention, the present invention is not limited to the following embodiments, and can be replaced with other various constitutions within a scope of a concept of the present invention.

Embodiment 1

Image Forming Apparatus

With reference to FIG. 14, an image forming apparatus 100 according to this embodiment will be described. FIG. 14 is a sectional view showing a general structure of an example of the image forming apparatus (a full color printer in this embodiment) 100 using an electrophotographic recording technique.

In the image forming apparatus 100, an image forming portion 1 for forming images on a recording material with toners includes four image forming stations Sa, Sb, Sc, and Sd for yellow, magenta, cyan, and black, respectively. The respective image forming stations include photosensitive drums 2*a*, 2*b*, 2*c*, and 2*d*, charging members 3*a*, 3*b*, 3*c*, and 3*d*, a laser scanner 4, developing devices 5*a*, 5*b*, 5*c*, and 5*d*, cleaners 6*a*, 6*b*, 6*c*, and 6*d* for cleaning the photosensitive drums, and transfer members 7*a*, 7*b*, 7*c*, and 7*d*.

The image forming portion 1 further includes a belt 8 for feeding toner images, transferred from the respective photosensitive drums 2*a*, 2*b*, 2*c*, and 2*d* by the transfer members 7*a*, 7*b*, 7*c*, and 7*d*, while carrying the toner images, and includes a secondary transfer member 9 for transferring the toner images from the belt 8 onto a recording material P. An operation of the image forming portion 1 is well known, and, therefore, will be omitted from detailed description.

The recording material P, such as recording paper, is accommodated in a cassette 10 in an apparatus main assembly 100A of the image forming apparatus 100, and is fed one by one to a roller pair 13 through a roller pair 12 by rotation of a roller 11. Then, the recording material P is fed to a secondary transfer portion, formed by the belt 8 and the secondary transfer member 9, by rotation of the roller pair 13, and the toner images are transferred onto the recording material P at the secondary transfer portion. The recording material P carrying unfixed toner images thereon is sent to a fixing device 20 as a fixing portion, and the toner images are heat fixed on the recording material P by the fixing device 20. The recording material P coming out of the fixing device 20 is discharged onto a tray 15 by rotation of a roller pair 14.

Fixing Device (Fixing Portion) 20

Figure 1:
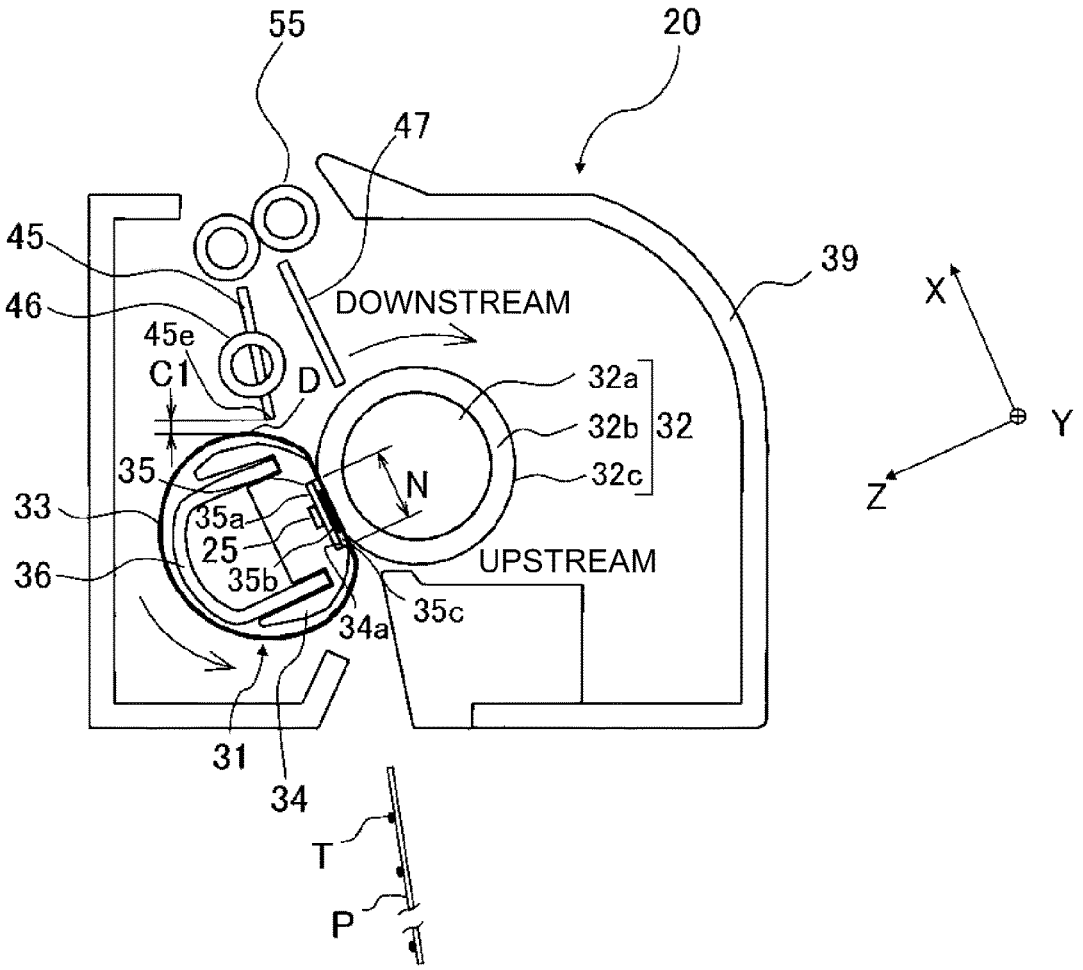
FIG. 1 is a sectional view showing a schematic structure of a fixing device according to Embodiment 1.
Figure 2:
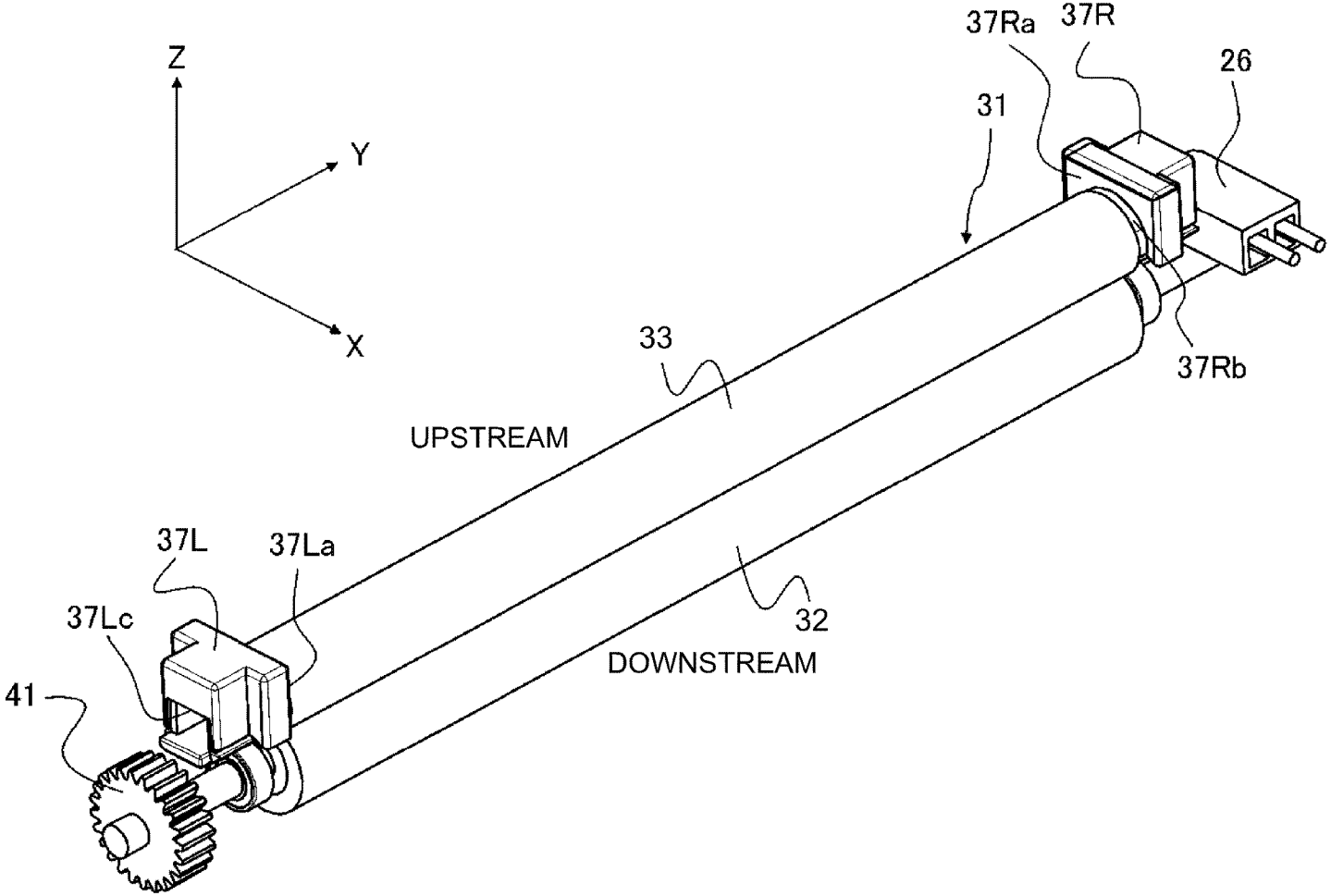
FIG. 2 is a perspective view showing a positional relationship between a film assembly and a pressing roller of the fixing device.
Figure 3:
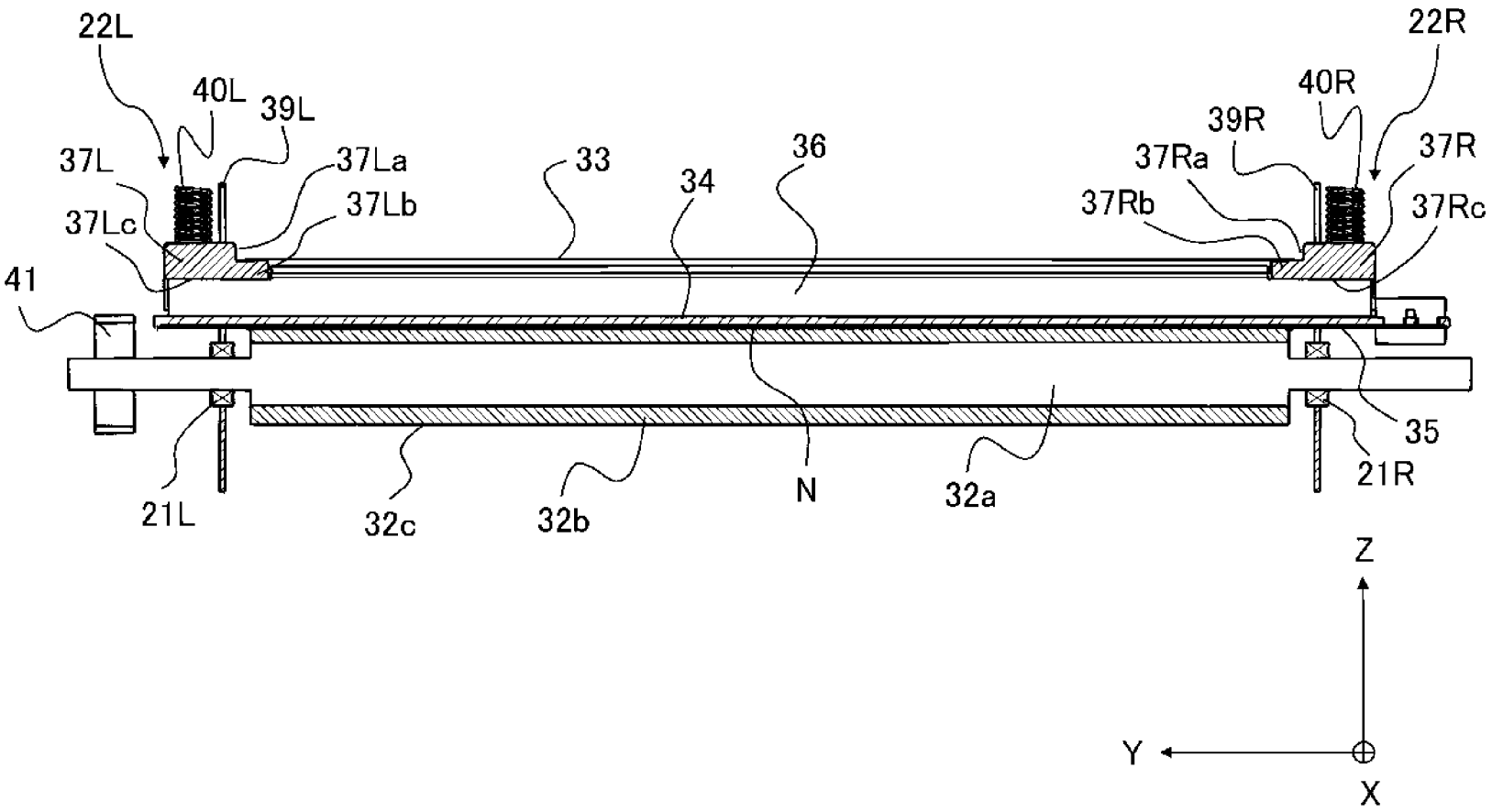
FIG. 3 is a sectional view showing a schematic structure of the fixing device as seen from a downstream side of a recording material feeding direction.

A structure of the fixing device 20 in this embodiment will be described with reference to FIGS. 1 to 3. FIG. 1 is a sectional view showing a schematic structure of the fixing device 20. FIG. 2 is a perspective view showing a positional relationship between a film assembly 31 and a pressing roller 32 of the fixing device 20. FIG. 3 is a sectional view showing a schematic structure of the fixing device 20 as seen from a downstream side of a recording material feeding direction X.

As shown in FIGS. 1 and 2, the fixing device 20 includes the film assembly (heating unit) 31, the pressing roller (pressing member) 32, flanges (preventing members) 37L and 37R, a separating member 45, a feeding guide 47, a feeding roller pair 55, and a frame 39.

The film assembly 31 includes a flexible cylindrical film (flexible member) 33 and a ceramic heater (heating member) 35 contacting an inner peripheral surface (inner surface) of the film.

The film assembly 31 further includes a holder (supporting member) 34 for supporting the heater 35 and for guiding rotation of the film 33, and includes a stay (feeding member) 36 for pressing the holder 34 against the film inner surface.

The film 33 is composite layer structure in which a heat resistant resin belt or a metal belt is used as a base layer and, on an outer peripheral surface of the base layer, an elastic layer, a parting layer, and the like, are provided, and is a member that is thin as a whole and that has flexibility, high thermal conductivity, and low thermal capacity.

The holder 34 formed of a heat resistant resin material includes a groove 34*a* at a central portion of a surface thereof on the pressing roller 32 side. The groove 34*a* is provided along a longitudinal direction Y perpendicular to the recording material feeding direction X. The heater 35 is supported by the groove 34*a*.

On a surface of the holder 34 on a side opposite from the pressing roller 32 side, the stay 36 is provided. The stay 36 is formed of a metal material, such as iron, in a U shape in cross section.

With respect to the direction Y, the heater 35 includes a thin elongated substrate 35*a* formed of a ceramic material, such as aluminum nitride or alumina. On a surface of the substrate 35*a*, on the pressing roller 32 side, a heat generating resistance layer 35*b* is provided along a longitudinal direction of the substrate 35*a*. The heat generating resistance layer 35*b* is coated with a glass coating layer 35*c* as a protective layer for ensuring protection and an insulating property of the heat generating resistance layer 35*b*.

The pressing roller 32 is prepared by providing, on an outer peripheral surface of a metal core 32*a*, an elastic layer 32*b* formed of a silicone rubber, or the like, so as to have a predetermined hardness. In order to improve non-adhesiveness, on an outer peripheral surface of the elastic layer 32*b*, a fluorine containing resin layer 32*c* formed of polytetrafluorethylene (PTFE), perfluoroalkoxy alkane (PFA), or fluorinated ethylene propylene (FEP) may also be provided. Both end portions of the metal core 32*a* are rotatably supported by side plates 39L and 39R of the frame 39 via bearings 21L and 21R (FIG. 3).

With respect to the direction Y, the flanges 37L and 37R are supported by the side plates 39L and 39R, respectively, so as to be movable in a predetermined direction M (FIG. 8). The predetermined direction M refers to a direction in which the flanges 37L and 37R move toward and away from the pressing roller 32 (i.e., a direction in which a pressure exerted on a fixing nip N changes).

The flanges 37L and 37R includes side surfaces, opposing the film 33 with respect to the direction Y, constituting preventing surfaces 37La and 37Ra, respectively, for preventing movement of the film 33 in a generatrix direction. The preventing surfaces 37La and 37Ra are provided with arcuate (semi-circular) guiding portions 37Lb and 37Rb, respectively. The guiding portions 37Lb and 37Rb are inserted into a hollow portion of the film 33 at the end portions of the film 33. An inner peripheral surface of each of the end portions of the film 33 is supported by an outer peripheral surfaces of the respective guiding portion 37Lb and 37Rb. Both end portions of the stay 36 and the holder 34 are engaged in holes 37Lc and 37Rc of the flanges 37L and 37R and are thus supported and fixed by the flanges 37L and 37R.

Pressing Mechanisms 22L and 22R of Film Assembly 31

Figure 4:
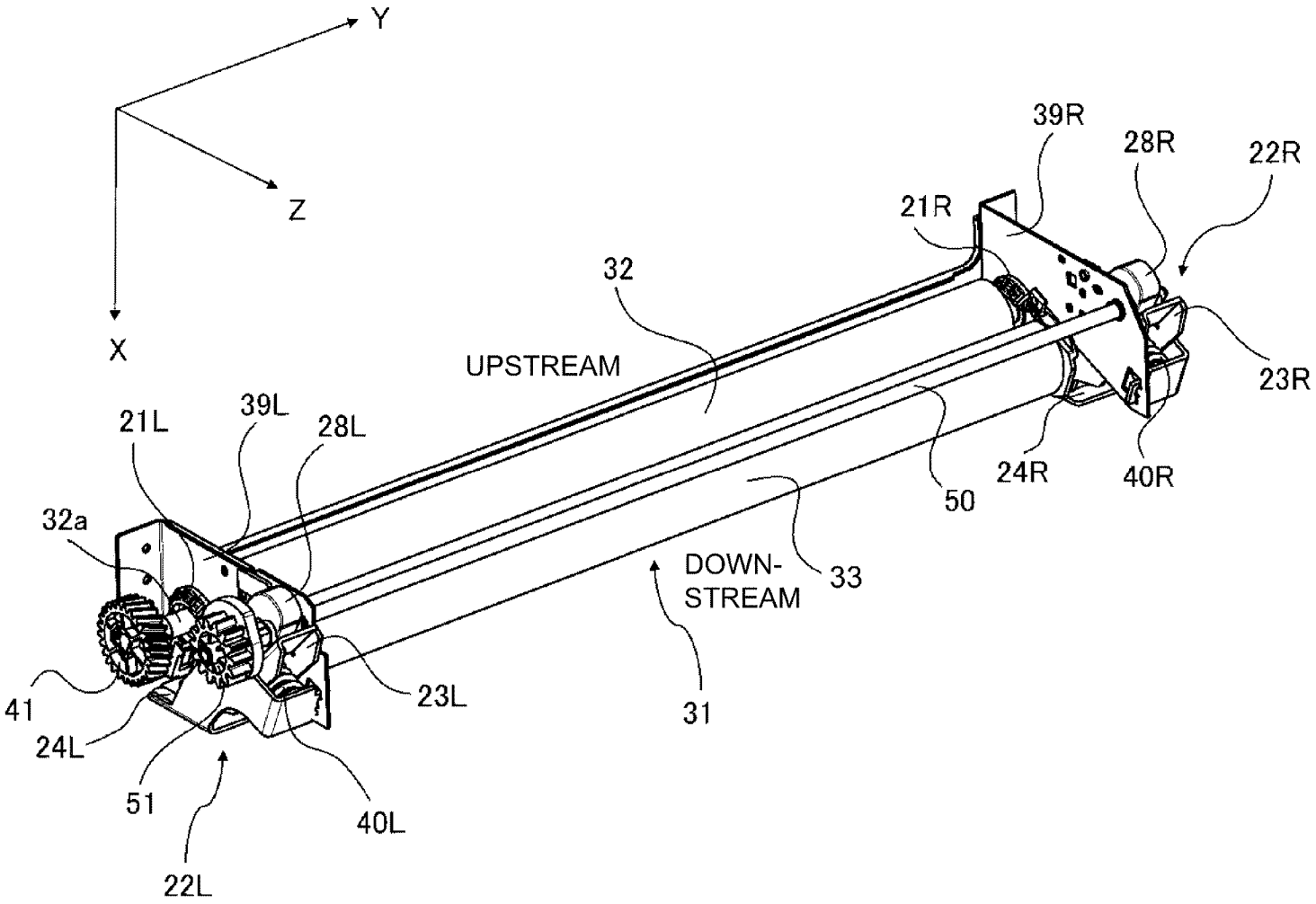
FIG. 4 is a perspective view showing a positional relationship among the film assembly, the pressing roller, and a pressing mechanism.

Pressing mechanisms 22L and 22R will be described with reference to FIG. 4. FIG. 4 is a perspective view showing a positional relationship among the film assembly 31, the pressing roller 32 and the pressing mechanisms 22L and 22R.

As shown in FIG. 4, the pressing mechanisms 22L and 22R include pressing plates 23L and 23R, support frames 24L and 24R, cams 28L and 28R, pressing springs 40L and 40R, a shaft 50, and a gear 51. End portions 23La and 23Ra (the end portion 23Ra of the pressing plate 23R being unshown, but having the same configuration as the end portion 23La of the pressing plate 23L, shown in FIG. 6) of the pressing plates 23L and 23R are supported by holes 24La and 24Ra (the hole 24Ra of the support frame 24R being unshown, but having the same configuration as the hole 24La of the support frame 24L shown in FIG. 6) of the support frames 24L and 24R mounted on the side plates 39L and 39R. Between the support frame 24L and the pressing plate 23L and between the support frame 24R and the pressing plate 23R, the pressing springs 40L and 40R are provided, respectively.

With respect to the direction Y, by the side plates 39L and 39R, the shaft 50 made of metal is rotatably supported. On the shaft 50, the cams 28L and 28R for changing the pressure (nip pressure) exerted on the nip N are provided at both end portions of the shaft 50, outside the side plates 39L and 39R. At the end portion of the shaft 50 on the cam 28L side, a gear 51 for transmitting a driving force to the shaft 50 is provided at an end portion of the metal core 32*a*. On the cam 28L side, which is the same side as the gear 51, a gear 41 for transmitting a driving force to the metal core 32*a* of the pressing roller 32 is provided. To these gears 41 and 51, the driving force of an unshown motor, as a driving source provided in the apparatus main assembly 100A, is transmitted via a gear train.

The gear train is constituted so that transmission of power is switched depending on a rotational direction of the motor. During normal rotation of the motor, the power (driving force) is transmitted to only the gear 41, so that the pressing roller 32 is rotated, and, during reverse rotation of the motor, the power is transmitted to only the gear 51, so that the cams 28L and 28R are rotated.

The pressing plates 23L and 23R are in contact positions during a printing operation, where the pressing plates 23L and 23R contact the flanges 37L and 37R, respectively, but are in spaced positions during turning off of a power source or during jam occurrence, where the pressing plates 23L and 23R are spaced from the flanges 37L and 37R, respectively. Switching between the contact position and the spaced position is carried out by swinging the pressing plate 23L or 23R relative to the support frame 24L or 24R by rotating the cam 28L or 28R.

Figure 5:
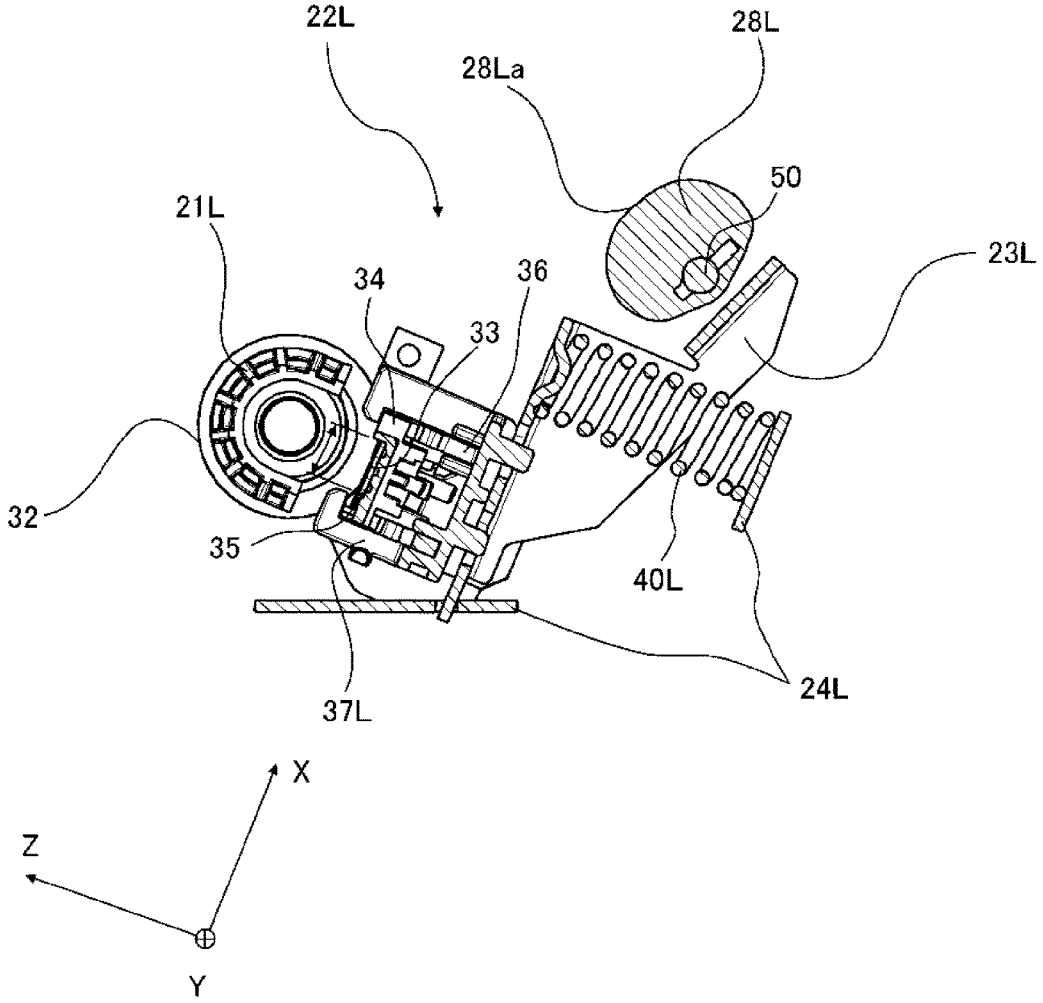
FIG. 5 is a sectional view showing a contact position of a pressing plate.
Figure 6:
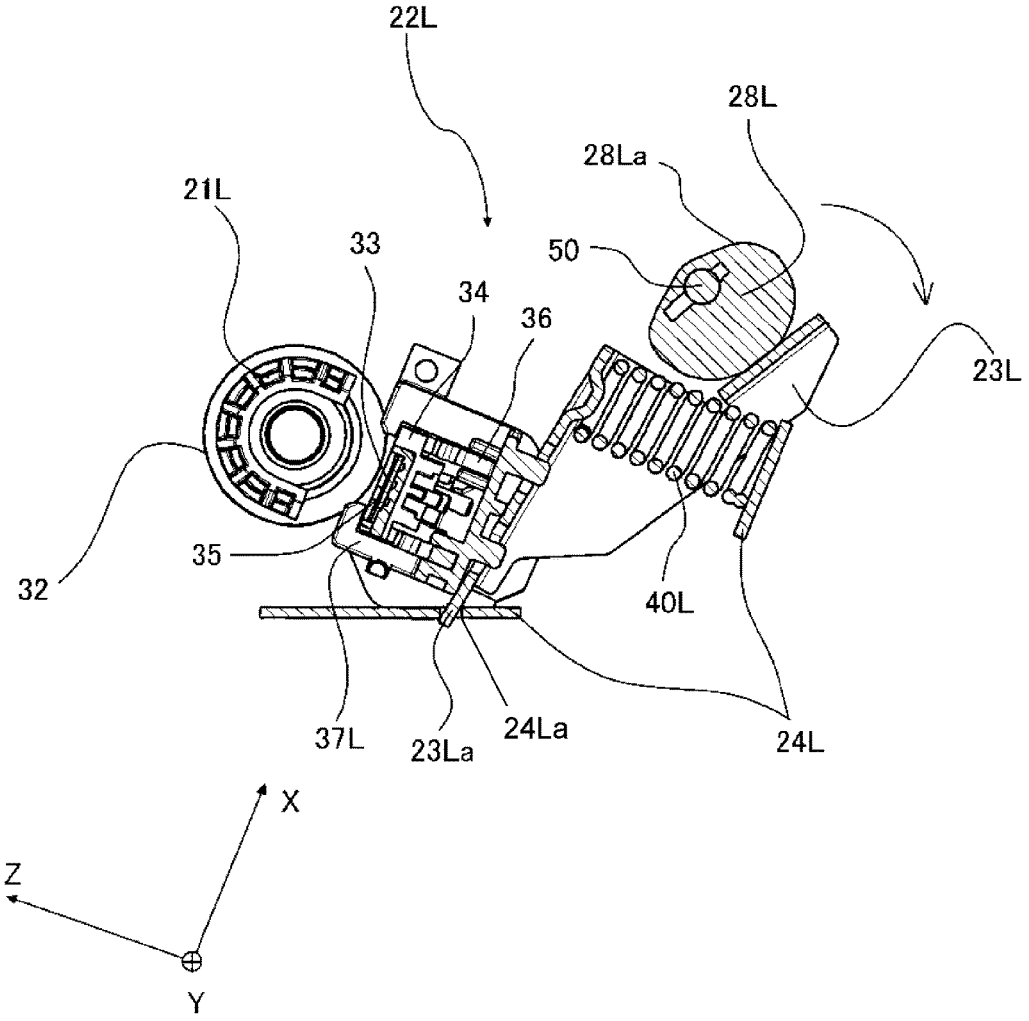
FIG. 6 is a sectional view showing a spaced position of the pressing plate.

The contact positions and the spaced positions of the pressing plates 23L and 23R will be described with reference to FIGS. 5 and 6. With respect to the direction Y, the pressing plates 23L and 23R are provided in a bilaterally symmetrical manner and perform the same operation, and, therefore, only the contact position and the spaced position of the pressing plate 23L will be described. FIG. 5 is a sectional view showing the contact position (i.e., a non-releasing position of the nip pressure), and FIG. 6 is a sectional view showing the spaced position (i.e., a releasing position of the nip pressure).

As shown in FIG. 5, the cam 28L includes a cam surface 28La for controlling the position of the pressing plate 23L. With reference to the direction Y, at one end portion of the shaft 50 where the cam 28*a* is fixed, a flag (not shown) for detecting a state of the nip N is provided. Blocking and non-blocking of light by this flag are detected using a (light) transmission sensor (not shown), whereby a released state and a non-released state of the nip pressure are detected.

During the printing operation of the image forming apparatus 100, as shown in FIG. 5, the cam 28L does not contact the pressing plate 23L. At this time, the pressing plate 23L is in the contact position where the pressing plate 23L is pressed by the pressing spring 40L and is contacted to the flange 37L.

In the contact position, the pressing plate 23L presses the flange 37L by a pressure (pressing force) of the pressing spring 40L, whereby the flange 37L is moved in a direction (recording material thickness direction Z) perpendicular to the generatrix direction of the film 33 and approaches the pressing roller 32. As a result, the flange 37L presses the heater 35 against the inner surface of the film 33 via the stay 36 and the holder 34, so that the outer peripheral surface of the film 33 is press-contacted to the outer peripheral surface of the pressing roller 32. As a result, the elastic layer 32*b* (FIG. 1) of the pressing roller 32 is depressed and elastically deformed, so that the nip (nip surface) N, having a predetermined width with respect to the recording material feeding direction X, is formed by the film surface and the pressing roller surface.

During the turning off of the power source or during the jam occurrence, as shown in FIG. 6, the cam 28L is rotated by the shaft 50, so that the cam surface 28La of the cam 28L is contacted to the pressing plate 23L. At this time, the pressing plate 23L is swung in an arrow direction against the pressure of the pressing spring 40L with one end portion 23La thereof as a supporting point, so that the pressing plate 23L is in the spaced position where the pressing plate 23L is spaced from the flange 37L.

In the spaced position, the pressing plate 23L releases the pressure of the pressing spring 40L exerted on the flange 37L, whereby the flange 37L is moved in the direction perpendicular to the generatrix direction of the film 33. As a result, the flange 37L raises the stay 36, the holder 34, the heater 35, and the film 33, whereby the film surface is spaced from the pressing roller surface.

In a state in which the pressing plates 23L and 23R are in the spaced positions, elastic deformation of the elastic layer 32*b* of the pressing roller 32 can be suppressed, and the recording material P jammed in the nip N can be removed.

In the spaced positions of the pressing plates 23L and 23R, as regards the release of the nip pressure, the pressure of the pressing springs 40L and 40R may also be reduced even when the pressure is not released. The reduction in pressure of the pressing springs 40L and 40R can be easily carried out by setting of shapes of the cam surfaces 28La and 28Ra of the cams 28L and 28R. Thus, by appropriately setting the shapes of the cam surfaces 28La and 28Ra, it is possible to prepare different patterns with various pressures.

Heat Fixing Process Operation

A heat fixing process operation of the fixing device 20 will be described with reference to FIG. 1.

The driving force of the motor provided in the apparatus main assembly 100A is transmitted to the metal core 32*a* of the pressing roller 32 through the gear 41, whereby the pressing roller 32 is rotated in an arrow direction. The film 33 is rotated in an arrow direction by rotation of the pressing roller 32 while the inner surface of the film 33 slides on the glass layer 35*c* of the heater 35.

When electrical power is supplied from power source (not shown) to the heat generating resistance layer 35*b* of the heater 35 via an energizing connector 26 (FIG. 2), the heat generating resistance layer 35*b* generates heat, so that the heater 35 is abruptly increased in temperature. A temperature controller (not shown) acquires a detection temperature detected by a temperature detecting element 25 provided in the holder 34 and controls an amount of energization to the heat generating resistance layer 35*b* so as to maintain the detection temperature at a predetermined fixing temperature (target temperature).

The recording material P carrying the unfixed toner image thereon is heated by being nipped and fed through the nip N, whereby the toner image is fixed on the recording material P.

Separating Member 45

The separating member 45 will be described with reference to parts (a) and (b) of FIGS. 7 and 8. Part (a) of FIG. 7 is perspective view of the film assembly 31 and the separating member 45 as seen from a left side of the direction Y, and part (b) of FIG. 7 is a perspective view of the film assembly 31 and the separating member 45 as seen from a right side of the direction Y. Part (a) of FIG. 8 is a sectional view of the separating member 45, the film 33, and the pressing roller 32 as seen from a left side of the direction Y, and part (b) of FIG. 8 is a sectional view of the separating member 45, the film 33, and the pressing roller 32 as seen from a right side of the direction Y.

The flexible film 33 is rotated in the arrow direction shown in FIG. 1 by rotation of the pressing roller 32. In a film rotation state, the film 33 is supported so that the inner peripheral surface of the film 33 at both end portions contacts the outer peripheral surfaces of the guiding portions 37Lb and 37Rb of the flanges 37L and 37R. For this reason, in the neighborhoods of the guiding portions 37Lb and 37Rb, degrees of deformation and movement of the film 33 are small. That is, the flanges 37L and 37R guide rotation of the film 33 by the guiding portions 37Lb and 37Rb.

As shown in FIG. 1, the recording material P, on which the unfixed toner image T is formed, is nipped and fed through the nip N in a state in which the rotation of the film 33 is guided by the guiding portions 37Lb and 37Rb of the flanges 37L and 37R. Then, as regards the recording material P, a leading end portion of the recording material P is separated from the film surface by curvature separation such that curvature of a recording material separating portion D of the surface of the film 33 is ensured in a certain amount at a position downstream of the nip N with respect to the recording material feeding direction X, and then the recording material P is fed.

When the curvature of the separating portion D of the surface of the film 33 is set at an excessively small value, however, a change in bending with the rotation of the film 33 becomes large. As a result, there is a possibility that fatigue fracture with repetitive bending is caused by the rotation of the film 33. For this reason, in this embodiment, the curvature of the separating portion D of the surface of the film 33 is suppressed to a level of not less than a certain amount.

As regards recording materials P different in material and thickness and recording materials P different in a fixing condition, separation of the recording material P from the separating portion D of the surface of the film 33 cannot be maintained in some cases. For this reason, in this embodiment, the separating member 45 for separating the recording material P from the surface of the film 33 is disposed in the neighborhood of the film surface while being spaced from the film surface by a distance C1 on a side downstream of the separating portion D with respect to the recording material feeding direction X.

The distance C1 is an interval from the separating portion D of the surface of the film 33 to an upstream end 45*e* of the separating member 45 with respect to the recording material feeding direction X. When the distance C1 is set within a predetermined distance range, separation of the recording material P from the surface of the film 33 by the separating member 45 can be carried out.

In a case in which the film 33 is constituted by a metal sleeve, the end 45*e* of the separating member 45 may desirably be spaced from the separating portion D of the film surface with the distance C1 set at about 0.3 mm to 2.0 mm. In this embodiment, the distance C1 was set at 1.5 mm.

In a case in which the film 33 is rotated by the rotation of the pressing roller 32, when the distance C1 is excessively large, the separation of the recording material P cannot be carried out. On the other hand, when the distance C1 is excessively small, the end 45*e* of the separating member 45 contacts the surface of the film 33, whereby the surface of the film 33 is damaged and thus, an image quality of the fixed image on the recording material P is lowered.

Therefore, in this embodiment, on a side downstream of the nip N with respect to the recording material feeding direction X and in a position close to the separating portion D of the surface of the film 33, the separating member 45 is disposed.

As shown in parts (a) and (b) of FIG. 7, with respect to the direction Y, the flanges 37L and 37R disposed outside a recording material feeding region are provided with the holes 37La and 37Ra on a downstream side of the recording material feeding direction X.

The separating member 45 is disposed on a side downstream of the film assembly 31 with respect to the recording material feeding direction X. With respect to the direction Y, the separating member 45 is disposed in parallel with the film 33 of the film assembly 31 so as to cover an entirety of the recording material feeding region.

As shown in parts (a) and (b) of FIG. 7, with respect to the direction Y, at both end portions of the separating member 45 on an upstream side of the recording material feeding direction X, shaft portions (first portions) 45La and 45Ra rotatably are supported in the holes 37La and 37Ra of the flanges 37L and 37R. By supporting the shaft portions 45La and 45Ra in the holes 37La and 37Ra, the distance C1 from the separating portion D of the surface of the film 33 to the end 45*e* of the separating member 45 is held with accuracy.

Further, the separating member 45 includes a guiding portion 45*c* provided along the recording material feeding direction X and having a feeding surface 45*c*1 on which a printing surface of the recording material P slides, and includes a rotatable roller 46, provided on an upstream side of the guiding portion 45*c* with respect to the recording material feeding direction X, for feeding the recording material P to a feeding surface. With reference to the direction Y, a plurality of guiding portions 45*c* and a plurality of rollers 46 are provided.

As shown in parts (a) and (b) of FIGS. 7 and 8, at both end portions of the separating member 45 with respect to the direction Y, positioned at a downstream end portion of the separating member 45 with respect to the recording material feeding direction X, long hole portions (second portions)

45Lb and 45Rb which are rotation preventing portions (rotation stoppers) of the separating member 45 are provided. The long hole portions 45Lb and 45Rb are formed in such a shape that the long hole portions 45Lb and 45Rb are parallel to a predetermined direction M in which the flanges 37L and 37R are movable. Further, the separating member 45 is locked by the shaft 50 on a downstream side with respect to the recording material feeding direction X. That is, into the long hole portions 45Lb and 45Rb, the shaft 50 is slidably inserted.

Recording Material Separating Operation (Process) of Separating Member 45

A recording material separating operation of the separating member 45 when a nip width is changed will be described with reference to FIGS. 9 and 10. FIG. 9 is a sectional view of the separating member 45 and the film 33 as seen from a left side of the direction Y in a case in which the width of the nip N is not changed. FIG. 10 is a sectional view of the separating member 45 and the film 33 as seen from the left side of the direction Y in a case in which the width of the nip N was changed.

As the recording material P, for example, in a case in which plain paper, having a small thickness, other than specialty paper, such as an envelope or a postcard, is nipped and fed through the nip N, the nip pressure is not changed. For that reason, the nip N is set so as to have a predetermined width, as shown in FIG. 9.

As the recording material P, in a case in which the specialty paper, such as the envelope or the postcard, having a large thickness is nipped and fed through the nip N, from viewpoints of a feeding property and an image fixing property, the nip pressure is reduced and thus, the nip N can be set so as to have a proper width in some instances.

Also in the fixing device 20 in this embodiment, in a case in which the envelope or the postcard is passed through the nip N, as shown in FIG. 10, the pressure exerted on the frame 37L by the pressing plate 23L is reduced. The reduction of the pressure exerted on the flange 37R is carried out by controlling an amount of rotation of the cam 28L by a motor. By reducing the pressure exerted on the flange 37L, the flange 37L is moved in a direction in which the flange 37L is spaced from the pressing roller 32. For this reason, a width of a nip N' is smaller than the width of the nip N shown in FIG. 9 (N>N').

With respect to the direction Y, the separating member 45 is supported by the flanges 37L and 37R so that the shaft portions 45La and 45Ra thereof are rotatably supported in the holes 37La and 37Ra of the flanges 37L and 37R. Further, the separating member 45 is movable (slidable) relative to the shaft 50 in the predetermined direction M by the long hole portions 45Lb and 45Rb thereof. A sliding direction M of the separating member 45 is a direction crossing a plane N of the nip and is substantially parallel to the sliding direction M of the flanges 37L and 37R.

As a result, as shown in FIGS. 9 and 10, the distance C1 between the end 45*e* of the separating member 45 and the surface of the film 33 is maintained while being roughly kept at a distance when the plain paper is nipped and fed through the nip N. Further, a distance C2 between a tangential line R of the nip N and a part of the separating member 45 parallel to the tangential line R does not change.

That is, when the width of the nip N was changed, as regards the separating member 45, the distance C1 between the surface of the film 33 and the separating portion D is roughly kept constant, and the distance C2 between the separating member 45 and the tangential line R does not change. As a result, a separating performance of the recording material P by the separating member 45 and a recording material feeding performance after separation can be compatibly realized. Incidentally, in this embodiment, a distance between the tangential line R of the nip N and an outer peripheral surface of the roller 46 is the distance C2.

Therefore, the recording material P is separated from the surface of the film 33 by the separating member 45 and then is fed. Although the toner image on the recording material P immediately after being passed through the nip N is heat fixed on the recording material P, in this stage, the toner image is not in a sufficiently stable state. For this reason, an image defect is liable to generate due to sliding of the toner image with the feeding surface 45*c*1 of the guiding member (portion) 45*c*. In this embodiment, the recording material P can be fed to the feeding surface 45*c*1 of the guiding member 45*c* by the roller 46 provided on the separating member 45, and, therefore, the image defect does not generate and thus a good image quality was able to be maintained.

Embodiment 2

Another embodiment of the fixing device 20 will be described. The fixing device 20 in this embodiment has the same constitution as that of the fixing device 20 of Embodiment 1 except that a shape of long hole portions 45Lb and 45Rb of a separating member 45 of the fixing device 20 is different from that of the long hole portions 45Lb and 45Rb in Embodiment 1.

The long hole portions 45Lb and 45Rb of the separating member 45 will be described with reference to parts (a) and (b) of FIG. 11. Part (a) of FIG. 11 is a sectional view of the separating member 45, the film 33, and the pressing roller 32 as seen from a left side of the direction Y, and part (b) of FIG. 11 is a sectional view of the separating member 45, the film 33, and the pressing roller 32 as seen from a right side of the direction Y. In the separating member 45, the long hole portions 45Lb and 45Rb are formed in such a shape that the long hole portions 45Lb and 45Rb cross a predetermined direction M in which the flanges 37L and 37R are movable. Into the long hole portions 45Lb and 45Rb, the shaft 50 is slidably inserted.

Recording Material Separating Operation (Process) of Separating Member 45

A recording material separating operation of the separating member 45 when a nip width is changed will be described with reference to FIGS. 12 and 13. FIG. 12 is a sectional view of the separating member 45 and the film 33 as seen from a left side of the direction Y in a case in which the width of the nip N is not changed. FIG. 13 is a sectional view of the separating member 45 and the film 33 as seen from the left side of the direction Y in a case in which the width of the nip N was changed.

In some cases, the recording material P entering the nip N causes a jam by winding about the surface of the film 33, or the recording material P, immediately after being discharged from the nip N, causes the jam due to improper entrance into the feeding guide 47 (FIG. 1).

Also in the fixing device 20 in this embodiment, in a case in which the jam occurred, from viewpoints of a jam clearance property of a user and avoidance of breakage of the film 33, the nip pressure of the nip N can be released. The nip pressure releasing method is described in Embodiment 1, and, therefore, will be omitted from detailed description.

As shown in FIG. 13, by reducing the pressure exerted on the flange 37L by an unshown pressing plate 23L in FIG. 13, the flange 37L is moved in a direction in which the flange 37L is spaced from the pressing roller 32. For this reason, a width of a nip N' is less than the width of the nip N shown in FIG. 12 (N>N'). On the other hand, a distance C1' between the end 45*e* of the separating member 45 and the separating portion D of the surface of the film 33 is greater than the distance C1 shown in FIG. 12 (C1>C1'). For this reason, the user can easily remove the jammed recording material P without breaking the film 33. The distance C1' is set at a distance to the extent that the distance C1' has no influence on a recording material separating performance of the separating member 45.

With respect to the direction Y, the separating member 45 is supported by the flanges 37L and 37R so that the shaft portions 45La and 45Ra thereof are rotatably supported in the holes 37La and 37Ra of the flanges 37L and 37R. Further, the separating member 45 is movable (slidable) relative to the shaft 50 in a direction crossing the predetermined direction M by the long hole portions 45Lb and 45Rb thereof.

As a result, the distance C1 between the end 45*e* of the separating member 45 and the surface of the film 33 shown in FIG. 12 can be made large as in the case of the distance C shown in FIG. 13. That is, the long hole portions 45Lb and 45Rb have a shape such that the distance C1 increases when the flanges 37L and 37R move in the predetermined direction M.

Further, as shown in FIGS. 12 and 13, a distance C2 between a tangential line R of the nip N and a part of the separating member 45 parallel to the tangential line R does not change.

That is, when the width of the nip N was changed, as regards the separating member 45, the distance C1 between the surface of the film 33 and the separating portion D increases, but the distance C2 between the separating member 45 and the tangential line R does not change. As a result, a separating performance of the recording material P by the separating member 45 and a recording material feeding performance after separation can be compatibly realized.

As shown in FIG. 11, the long hole portions 45Lb and 45Rb of the separating member 45 are supported by the shaft 50 at end portions 45Lb1 and 45Rb1 on a side thereof close to the film assembly 31. In a case in which a positional relationship between the end 45*e* of the separating member 45 and the shaft 50 is reversed, the long hole portions 45Lb and 45Rb of the separating member 45 are supported by the shaft 50 at end portions 45Lb2 and 45Rb2 on a side remote from the film assembly 31.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a cylindrical film;

a nip forming member configured to form a nip between itself and said film when in contact with an outer surface of said film;

a preventing member provided in a position opposing an end portion of said film with respect to a generatrix direction of said film and configured to prevent movement of said film in the generatrix direction;

a frame; and a separating member configured to separate, from said film, a recording material discharged from the nip, said separating member being rotatable relative to said preventing member at a first portion thereof, and being slidable relative to said frame at a second portion thereof, said second portion of said separating member being in a position that is more remote from a surface of said film than is said first portion, and a sliding direction of said separating member crossing a plane of the nip, wherein said fixing device fixes, at the nip, a toner image on the recording material while nipping and feeding the recording material on which the toner image is formed.

2. A fixing device according to claim 1, wherein said preventing member is provided on said frame so as to be movable in a direction substantially perpendicular to the plane of the nip, and wherein said second portion of said separating member is slidable in a direction substantially parallel to the movement direction of said preventing member.

3. A fixing device according to claim 2, wherein one of said second portion of said separating member and said frame includes a long hole, and the other one of said second portion of said separating member and said frame includes a shaft engageable and slidable in said long hole.

4. A fixing device according to claim 3, further comprising a rotatable cam configured to change a pressure exerted on the nip, wherein said shaft is a rotation shaft of said cam.

5. A fixing device according to claim 1, wherein said preventing member is provided on said frame so as to be movable in a direction substantially perpendicular to the plane of the nip, and wherein said second portion of said separating member is slidable in a direction non-parallel to the movement direction of said preventing member.

6. A fixing device according to claim 5, wherein one of said second portion of said separating member and said frame includes a long hole, and the other one of said second portion of said separating member and said frame includes a shaft engageable and slidable in said long hole.

7. A fixing device according to claim 1, further comprising a roller that is provided in a position of said separating member closer to said first portion than to said second portion, and to which the recording material passed through the nip is contactable.

8. A fixing device comprising:

a cylindrical film;

a nip forming member configured to form a nip between itself and said film when in contact with an outer surface of said film;

a frame;

a preventing member provided in a position opposing an end portion of said film with respect to a generatrix direction of said film and configured to prevent movement of said film in the generatrix direction, said preventing member being slidable relative to said frame in a direction in which a pressure exerted on the nip changes; and a separating member configured to separate, from said film, a recording material discharged from the nip, said separating member being rotatable relative to said preventing member at a first portion thereof, and being slidable relative to said frame at a second portion therefor, a sliding direction of said separating member being substantially parallel to a sliding direction of said preventing member, wherein said fixing device fixes, at the nip, a toner image on the recording material while nipping and feeding the recording material on which the toner image is formed.

9. A fixing device according to claim 8, wherein said second portion of said separating member is in a position that is more remote from a surface of said film than is said first portion.

10. A fixing device according to claim 8, wherein one of said second portion of said separating member and said frame includes a long hole, and the other one of said second portion of said separating member and said frame includes a shaft engageable and slidable in said long hole.

11. A fixing device according to claim 10, further comprising a rotatable cam configured to change the pressure exerted on the nip, wherein said shaft is a rotation shaft of said cam.

12. A fixing device according to claim 10, further comprising a roller that is provided in a position of said separating member closer to said first portion than to said second portion, and to which the recording material passed through the nip is contactable.

* * * * *